US006486646B2

(12) United States Patent
Kang

(10) Patent No.: US 6,486,646 B2
(45) Date of Patent: Nov. 26, 2002

(54) APPARATUS FOR GENERATING CONSTANT REFERENCE VOLTAGE SIGNAL REGARDLESS OF TEMPERATURE CHANGE

(75) Inventor: Han Kook Kang, Ichon (KR)

(73) Assignee: Hynix Semiconductor Inc., Kyoungki-do (KR)

( * ) Notice: Subject to any disclaimer, the term of this patent is extended or adjusted under 35 U.S.C. 154(b) by 0 days.

(21) Appl. No.: 09/994,752

(22) Filed: Nov. 28, 2001

(65) Prior Publication Data

US 2002/0070722 A1 Jun. 13, 2002

(30) Foreign Application Priority Data

Nov. 29, 2000 (KR) ..... 00-71515

(51) Int. Cl.[7] ..... G05F 3/16; G05F 3/20
(52) U.S. Cl. ..... 323/315; 323/313; 323/316
(58) Field of Search ..... 323/315, 316, 323/313

(56) References Cited

U.S. PATENT DOCUMENTS 4,633,165 A * 12/1986 Pietkiewicz et al. ..... 323/314
5,917,311 A * 6/1999 Brokaw ..... 323/280
6,211,661 B1 * 4/2001 Eckhardt ..... 323/316
6,218,822 B1 * 4/2001 MacQuigg ..... 323/313

* cited by examiner

*Primary Examiner*—Bao Q. Vu
(74) *Attorney, Agent, or Firm*—Birch, Stewart, Kolasch & Birch, LLP

(57) ABSTRACT

The present invention provides a reference voltage signal generator capable of generating a constant reference voltage signal regardless of temperature variation by compensating a voltage signal change due to temperature variation. The reference voltage signal generator includes: a voltage signal generating unit receiving a power supply voltage signal and generating a first voltage signal; a regulation sense amplifier generating a regulation voltage signal by regulating the first voltage signal according to the variation of the power supply voltage signal; and a voltage distributing unit including a variable resistor for compensating a voltage signal variation according to a change in temperature, wherein the voltage distributing unit distributes the regulation voltage signal and outputs a feedback voltage signal dependent on temperature to the regulation sense amplifier, and a reference voltage signal independent of the temperature.

16 Claims, 5 Drawing Sheets

APPARATUS FOR GENERATING CONSTANT REFERENCE VOLTAGE SIGNAL REGARDLESS OF TEMPERATURE CHANGE

FIELD OF THE INVENTION

The present invention relates to a reference voltage signal generator, and more particularly, to a reference voltage signal generator capable of generating a constant reference voltage signal regardless of a temperature change by effectively compensating voltage variation due to a change in the temperature.

DESCRIPTION OF THE PRIOR ART

A reference voltage signal generator is a device that generates a voltage signal used as a reference voltage signal of memory devices, e.g., flash memory devices adopting various levels of voltage signals generated from one power supply voltage signal.

Generally, the reference voltage signal generator must generate constant reference voltage signals even if the output voltage signal of the power supply varies.

Referring to FIG. 1, a conventional reference voltage signal generator comprises a first voltage signal generating unit 110, a regulation sense amplifier 120, a voltage distributing unit 130 and a second voltage signal generating unit 140. The first voltage signal generating unit 110 receives a power supply voltage signal in response to an enable signal En and generates a first voltage signal V11 of a predetermined value.

The regulation sense amplifier 120 receives the first voltage signal V11 from the first voltage signal generating unit 110 in response to the enable signal En and generates a regulated voltage signal Vr to the voltage distributing unit 130. Furthermore, the regulation sense amplifier 120 also receives a feedback voltage signal Vfb from the voltage distributing unit 130 and generates the constant regulation voltage signal Vr independently of any change in the voltage signal level of the power supply.

The second voltage signal generating unit 140, which has the same configuration as that of the first voltage signal generating unit 110, receives the constant regulation voltage signal Vr and generates a reference voltage signal Vref which is stable and constant. In FIG. 1, the numeral references 'I100' and 'S100' are an inverter and a switching element, respectively.

Although the conventional reference voltage signal generator can generates a constant reference voltage signal Vref independently of any change in the voltage signal variation of the power supply, the constant reference voltage signal Vref may be changed by effect of a change of temperature.

That is, resistors R11 and R12 of the voltage distributing unit 130 do not reflect the temperature change, therefore it is difficult to compensate the voltage signal variation due to the change in temperature.

SUMMARY OF THE INVENTION

It is, therefore, an object of the present invention to provide a reference voltage signal generator capable of generating a constant reference voltage signal regardless of a change in temperature, by compensating voltage signal change due to the temperature variation.

It is, therefore, another object of the present invention to provide a reference voltage signal generator comprising a variable resistor for compensating the voltage signal variation according to a change in temperature, in order to produce a constant reference voltage signal, even if the temperature changes.

In accordance with another aspect of the present invention, there is provided a reference voltage signal generating device comprising: a voltage signal generating unit receiving a power supply voltage signal and generating a first voltage signal; a regulation sense amplifier generating a regulation voltage signal by regulating the first voltage signal according to the variation of the power supply voltage signal; and a voltage distributing unit including a variable resistor for compensating a voltage signal variation according to a change in temperature, wherein the voltage distributing unit distributes the regulation voltage signal and outputs a feedback voltage signal dependent on a temperature to the regulation sense amplifier, and a reference voltage signal independent of the temperature.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE PREFERRED EMBODIMENTS

Hereinafter, a reference voltage signal generator according to embodiments of the present invention will be described in detail referring to the accompanying drawings.

Figure 1:
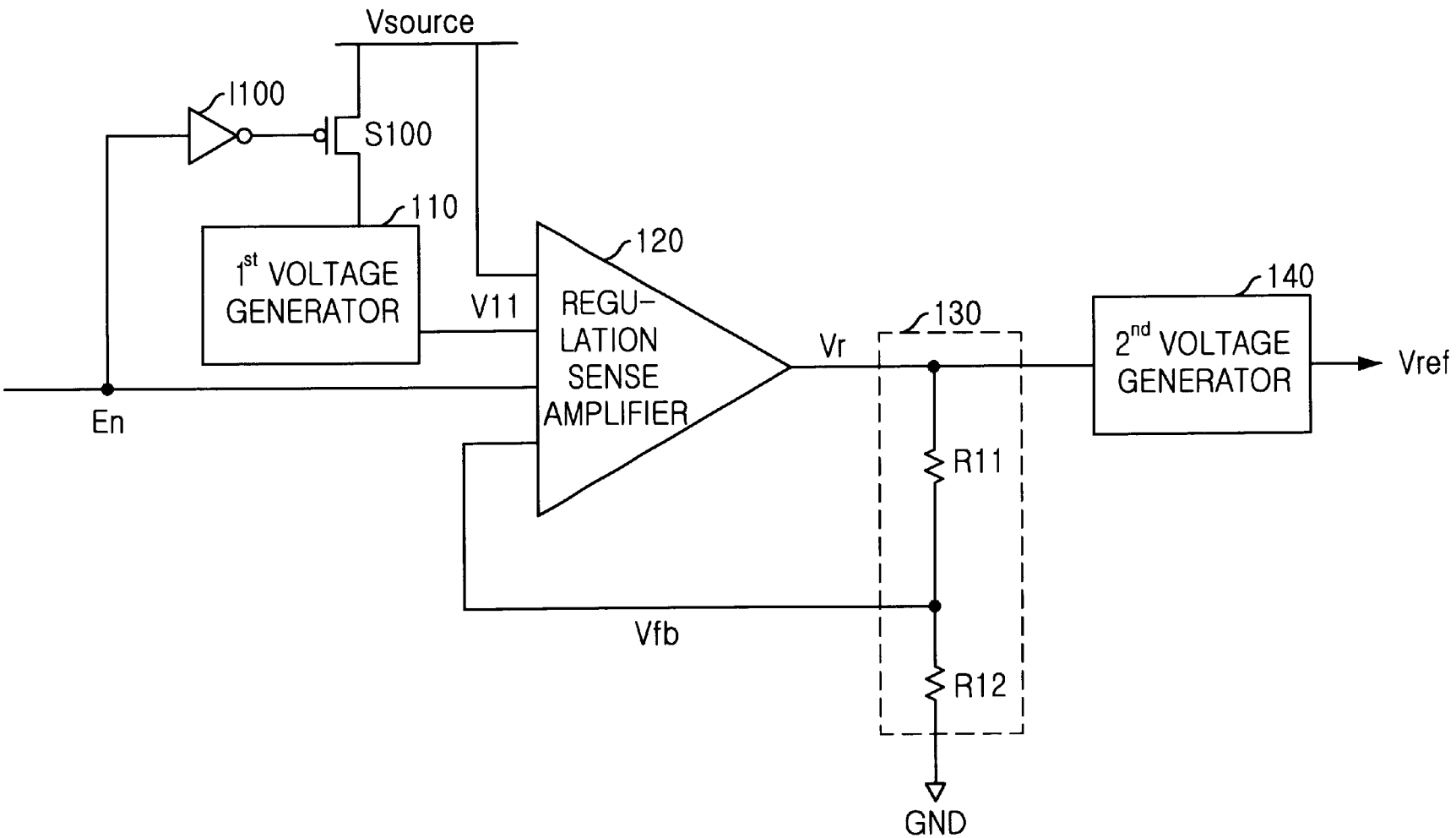
FIG. 1 (PRIOR ART)
FIG. 1 is a circuit diagram showing a configuration of the conventional reference voltage signal generator.
Figure 2:
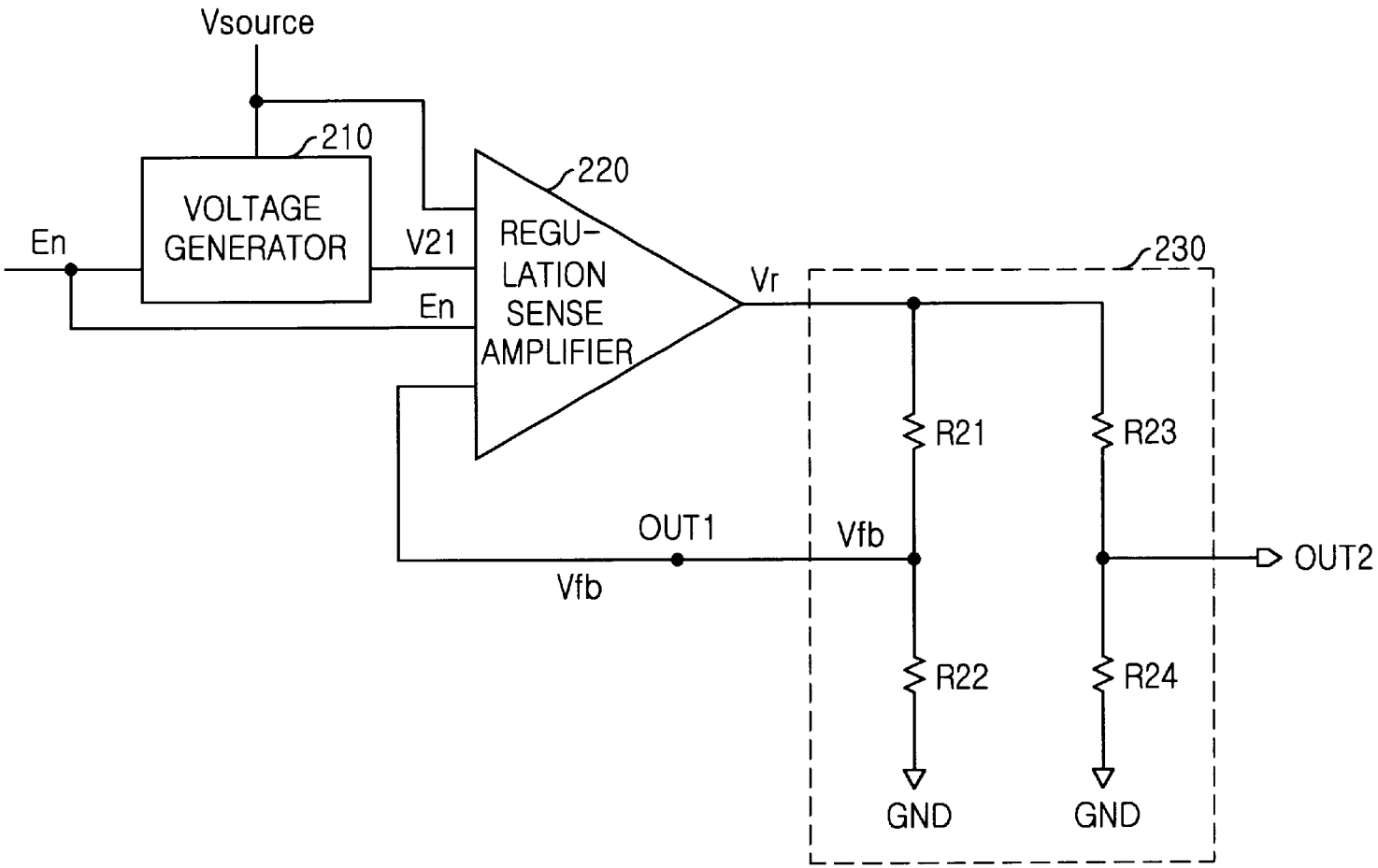
FIG. 2 is a circuit diagram showing a configuration of a reference voltage signal generator according to the present invention.

Referring to FIG. 2, a reference voltage signal generator, in accordance with the present invention, comprises a voltage signal generating unit 210, a regulation sense amplifier 220 and a voltage distributing unit 230.

The voltage signal generating unit 210 receives a power supply voltage signal Vsource in response to an enable signal En and outputs a first voltage signal V21 to the regulation sense amplifier 220. The regulation sense amplifier 220 receives the first voltage signal V21 from the voltage signal generating unit 210 in response to the enable signal En and a feedback voltage signal Vfb, varying with temperature, from the voltage distributing unit 230, and the regulation sense amplifier 220 generates a constant regulation voltage signal Vref independently of any change in the voltage signal level of the power supply. The voltage distributing unit 230 comprises two output terminals OUT1 and OUT2, three normal resistors R21, R23 and R24 and a variable resistor R22 for compensating voltage signal variation according to a change in temperature. The voltage distributing unit 230 receives the regulation voltage signal Vr from the regulation sense amplifier 220 and outputs the feedback voltage signal Vfb, varying according to a change in temperature, to a first output terminal OUT1 connected to the regulation sense amplifier 220, and the voltage distributing unit 230 also outputs a reference voltage signal Vref to a second output terminal OUT2.

The reference voltage signal generator of the present invention will be explained in detail, referring to FIGS. 2 to 4.

Figure 3:
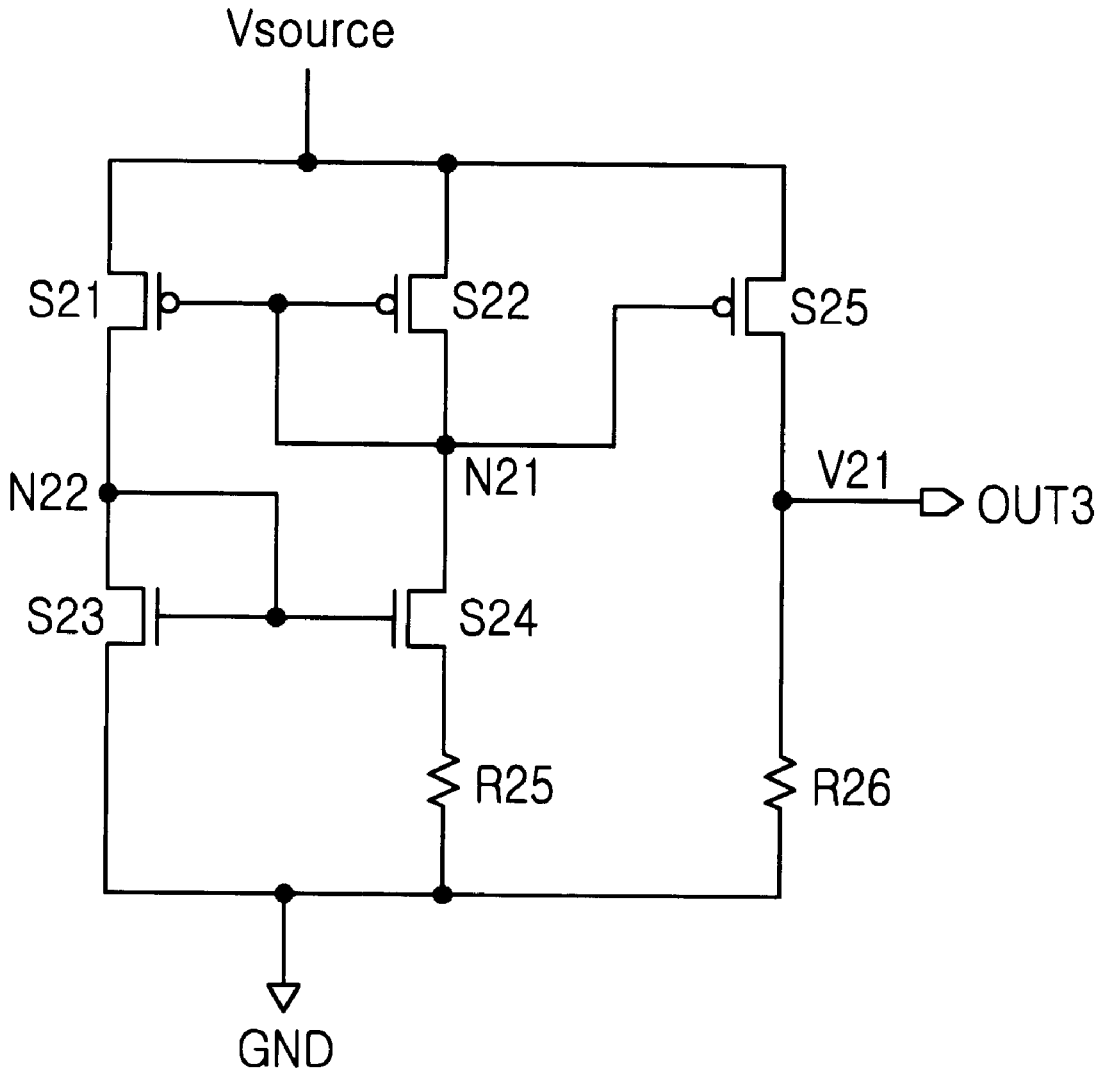
FIG. 3 is a circuit diagram showing a configuration of a voltage signal generating unit of the reference voltage signal generator shown in FIG. 2.

FIG. 3 is a circuit diagram showing the configuration of the voltage signal generating unit 210 in FIG. 2.

The voltage signal generating unit 210 comprises an electric current mirror including four switching elements (from S21 to S24), a switching element S25, and two resistors R25 and R26. That is, the voltage signal generating unit 210 comprises the current mirror comprising the switching elements S21 and S22 receiving the power supply voltage signal Vsource, respectively, the switching element S23 connected between the switching element S21 and the ground GND, and the switching element S24 connected to the switching element S23. The switching element S21 is a PMOS transistor, and the switching element S22 is a diode-connected PMOS transistor. The switching element S23 is an NMOS transistor, and the switching element S23 is a diode-connected NMOS transistor. Also, gates of the switching element S21 and S22 are connected to each other and are applied the voltage signal on node N21 which is a connecting point of the switching elements S22 and S24. Gates of the switching element S23 and the switching element S24 are connected to each other and are applied the potential on node N21 which is a connecting point of the switching elements S22 and S24.

Also, the voltage signal generating unit 210 further comprises the switching element S25, resistors R25 and R26. The switching element S25 is a PMOS transistor connected to the switching element S22 and an output terminal OUT3 from which the regulation voltage signal Vr is outputted, the potential at node N21 is applied to the gate of the switching element S25. The resistor R25 is connected between the switching element 24 and the ground GND, and the resistor R26 is connected between the output terminal OUT3 and the ground GND and is connected in parallel with the resistor R25.

Figure 4:
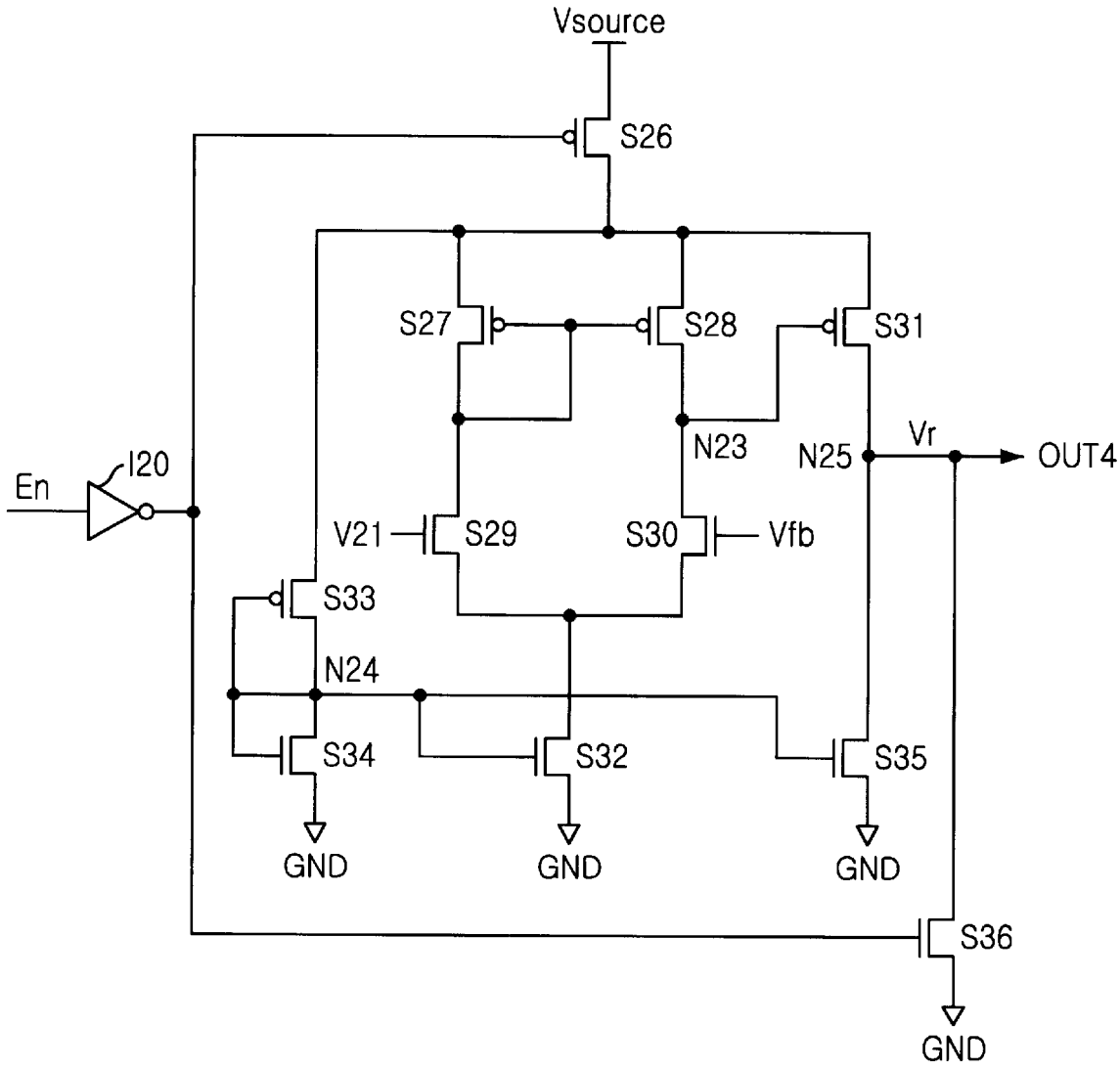
FIG. 4 is a circuit diagram showing configuration of a regulation sense amplifier of the reference voltage signal generator shown in FIG. 2.

Referring to FIG. 4, the regulation sense amplifier 220 comprises a switching element S26 operating in response to the enable signal En and receiving the power supply voltage signal Vsource, a current mirror including switching elements S27 and S28, a switching element S29 connected to the seventh switching element S27 and receiving signals from the voltage signal generating unit 210, a switching element S30 connected the switching elements S28 and S29, a switching element S32 connected to the common node of the switching elements S29 and S30 and the ground GND, a switching element S31 connected to the switching element S26 and the output terminal OUT4, a switching element S33 connected to the switching element S27, a switching element S34 connected to the switching element S33 and the ground GND, a switching element S35 connected to the switching element S31 and the ground GND, and a switching element S36 connected to the output terminal OUT4 and the ground GND. In FIG. 4, the numerical reference 'I20' denotes an inverter.

The switching element S26 is a PMOS transistor that operates in response to the enable signal En, and the switching element S27 is a diode-connected PMOS transistor, and the switching element S28 is a PMOS transistor of which gate is connected to the gate of the seventh switching element S27. The switching element S29 is an NMOS transistor of which gate receives the first voltage signal V21 from the voltage signal generating unit 210, and the switching element S30 is an NMOS transistor of which gate receives the feedback voltage signal Vfb from the voltage distributing unit 230. The switching element S31 is a PMOS transistor of which gate receives potential on node N23, a connecting point of the switching element S28 and S30, the switching element S33 is a diode-connected PMOS transistor, and the switching element S34 is a diode-connected NMOS transistor. The gates of the switching elements S33 and S34 are connected to each other. The switching elements S32 and S35 are NMOS transistors of which gates receive the potential on node N24, a connecting point of the switching elements S33 and S34.

The switching element S36 is an NMOS transistor, connected to the output terminal OUT4 and node N25, a connecting point of the switching elements S31 and S35, and the switching element S36 operates in response to the enable signal En. The switching element S32, S34 and S36 are connected to the ground GND with the switching element S35.

In the meantime, the threshold voltage of the switching element S33 and S34 are controlled in manufacturing processes in order to determine the potential on node N24. The switching element S32 regulates the amount of current flowing to the switching elements S29 and S30 according to the electrical potential at node N24.

Also, the switching element S35, connected to node N25 and the ground GND, plays a role of a load resistor according to potential at node N24.

Referring to FIG. 2, the voltage distributing unit 230 comprises a resistor R21 connected to the output terminal OUT1, from which the feedback voltage signal Vfb is outputted, a resistor R22 connected to the output terminal OUT1 and the ground GND, a resistor R23 connected to the output terminal of the regulation sense amplifier 220 and the second output terminal OUT2, from which the reference voltage signal Vref is outputted, and a resistor R24 connected the ground and the output terminal OUT2 shared with the resistor R23.

The resistors R21, R23 and R24 are normal resistors of which resistance values are not changed according to the change of temperature, but the resistor R22 is a variable resistor for compensating voltage signal variation according to a change in temperature.

Hereinafter, the operation of the reference voltage signal generator according to the present invention will be described in detail.

First, the operation of the voltage signal generating unit 210 shown in FIG. 3 is the same as the following.

The resistance value of the resistor R25 is regulated in order to generate the first voltage signal V21 from the voltage signal of the power supply.

If the resistance value of the resistor R25 is increased, the current flowing to the switching element S24 is decreased, and the potential on N21 increases. The current flowing to the output terminal of the voltage signal generating unit 210 decrease because the potential at node N21 is not quite enough to turn-on the switching element S25.

When the current flowing to the output terminal OUT3 decreases, the voltage drop is generated by the resistor R26, and the voltage across the resistor R26 is outputted to the output terminal OUT3.

On the other hand, the potential at node N21 is decreased in proportion to the resistance value of the resistor R25, and a high level of the first voltage signal V21 is outputted to the output terminal OUT3. In case that the potential at node N21 is low, the fifth switching element S25 is partially turned-on, so that the maximum value of current can flow. Accordingly, a high voltage can be obtained from the resistor R26 by the maximum current, and the voltage of high level is outputted to the output terminal OUT3.

As mentioned above, the first voltage signal V21, the voltage signal of desired value obtained by regulating the resistance value of the resistor R25 in the voltage signal generating unit 210, is inputted to the regulation sense amplifier 220.

The value of the first voltage signal V21 may be different from the target value, when the power supply voltage signal Vsource is high or low. The regulation sense amplifier 220 senses the power supply voltage signal Vsource and regulates the first voltage signal V21 to a target value according as the voltage signal of the power supply is high or low.

Hereinafter, the operations of the regulation sense amplifier 220 and the voltage distributing unit 230 will be described in detail.

The regulation voltage signal Vr is determined by the comparison of the first voltage signal V21 and the feedback voltage signal Vfb.

When a low enable signal En is applied, the switching element S26 changes into turn-off state, and the output terminal OUT4 is disconnected from the ground. If a high enable signal EN is applied, the voltage signal of the power supply is applied to the current mirrors, which are composed of the switching elements S27 and S28 flowing same current. The switching elements S29 and S30 receive the current from the switching elements S27 and S28, respectively.

At this time, the first voltage signal V21 is inputted from the voltage signal generating unit 210 to the gate of the switching element S29, and a feedback voltage signal Vfb is inputted from the voltage distributing unit 230 to the gate of the switching element S30. The feedback voltage signal Vfb is a voltage signal inputted to the regulation sense amplifier 220 from the voltage distributing unit 210 dividing the regulation voltage signal Vr to a predetermined voltage signal value.

The potential on node N23 increases because the current flowing to the switching element S30 is less than the current flowing to the switching elements S29, when the first voltage signal V21 is higher than the feedback voltage signal Vfb. At this time, the high potential at node N23 is applied to the gate of the switching element S31, the switching element S31 changes into a nearly turn-off state, and the potential at node N25, namely the regulation voltage signal Vr, becomes low.

In contrast to this, when the first voltage signal V21 is lower than the feedback voltage signal Vfb, the potential at node N23 decreases because the current flowing to the switching element S30 is greater than the current flowing to the switching element S29. At this time, the low potential at node N23 is applied to the gate of the switching element S31, the switching element S31 changes into the turn-on state, and the potential at the node N25, namely the regulation voltage signal Vr, becomes high.

By such a feedback operation, the regulation sense amplifier 220 regulates the first voltage signal V21 in order to generate the regulation voltage signal Vr.

In the meantime, the switching elements S32 and S35 serve as current sinkers, which flow a constant current from the current mirror to the ground GND and from the switching element S31 to the ground GND, respectively. The voltage signal applied to the switching elements S32 and S35 is controlled by the diode-connected switching elements S33 and S34. If the threshold voltages of the switching elements S33 and S34 are equal, half of the power supply voltage signal Vsource is applied to the gates of the switching elements S32 and S35 because the potential on the source of the switching element S33 is the same with the potential of the power supply voltage signal Vsource. If the threshold voltages of the switching elements S33 and S34 are not equal, the power supply voltage signal Vsource is divided according to the voltage distribution law shown in the following equation 1.

$$Vsource=Vtp+Vtn \qquad \text{Eq. 1.}$$

In Eq. 1, 'Vtp' and 'Vtn' are the voltages on the sources of the switching element S33 and S34, respectively. Therefore, the potential at node N24 is constant if the power supply voltage signal Vsource is constant, and the constant potential at node 24 is applied to the gates of the switching element S32 and S35, respectively. By the switching elements S32 and S35 flowing constant currents, the control of the regulation voltage signal Vr is performed only by the switching elements S27, S28 and S31.

The regulation voltage signal Vr outputted from the regulation sense amplifier 220 is distributed by the voltage distributing unit 230 including a variable resistor R22 for compensating voltage signal variation according to a change in temperature, and the distributed voltage is inputted to the regulation sense amplifier 220 again as the feedback voltage signal Vfb.

Figure 5A:
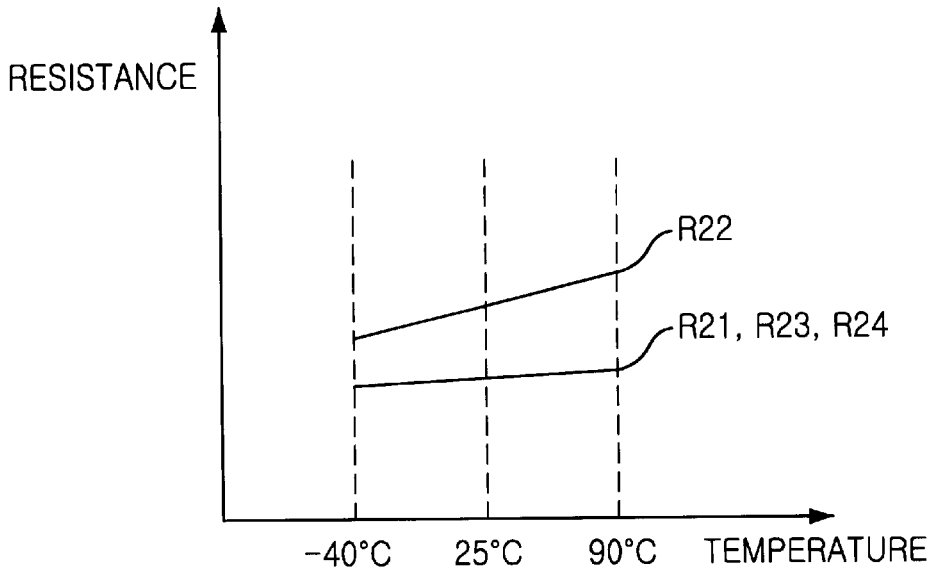
FIG. 5A is a graph showing resistor temperature coefficients of normal resistors and a variable resistor for compensating voltage signal variation according a change in temperature.

FIG. 5A is a resistor temperature coefficient graph that shows the temperature dependencies of the normal resistor R21, R23 and R24 and the variable resistor R22 for compensating voltage signal variation according to the change of temperature.

Referring to 5A, while the resistance values of normal resistors R21, R23 and R24 do not change (even if the temperatures changes), the resistance value of the variable resistor R22 changes.

Accordingly, as shown in the following Eq. 2, the feedback voltage signal Vfb, obtained from the output terminal OUT 1 connected to the variable resistor R22 increases in proportional to the resistance value of the variable resistor R22, namely the feedback voltage signal Vfb increases in proportional to temperature.

$$Vbf=Vr*(R4/(R3+R4)) \qquad \text{Eq. 2.}$$

Figure 5B:
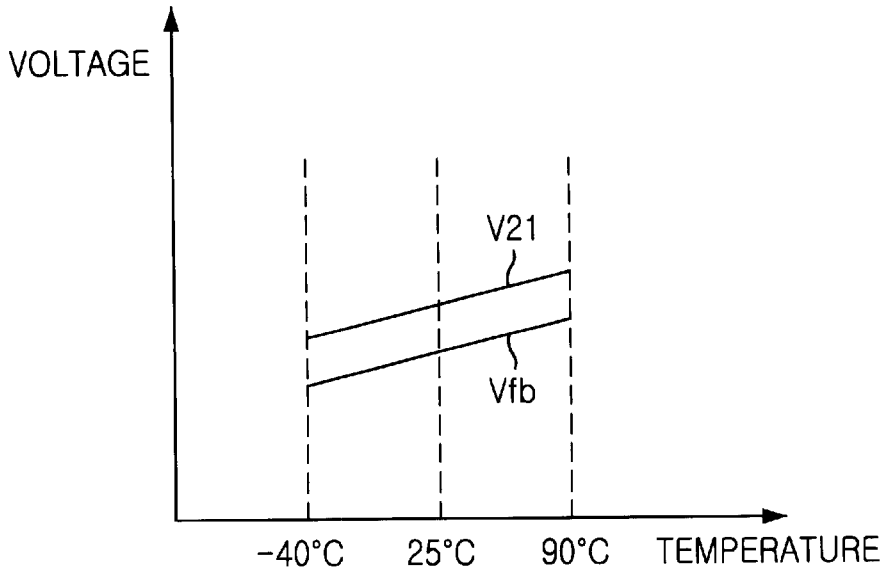
FIG. 5B is a graph showing temperature dependencies of a voltage signal outputted from the voltage signal generating unit and a feedback voltage signal outputted from the voltage distributing unit.

Referring to FIG. 5B, when the first voltage signal V21 inputted from the voltage signal generating unit 210 increases in response to the increase of the temperature, the feedback voltage signal Vfb, used for regulating the first voltage signal V21, is varied with the resistance value of the variable resistor R22, therefore, the constant reference voltage signal may be generated regardless of the change in temperature.

While the present invention has been described with respect to the particular embodiments, it will be apparent to those skilled in the art that various changes and modifications may be made without departing from the scope of the invention as defined in the following claims.

What is claimed is:

1. A reference voltage signal generating device comprising:

a voltage signal generating unit receiving a power supply voltage signal and generating a first voltage signal;

a regulation sense amplifier generating a regulation voltage signal by regulating the first voltage signal according to the variation of the power supply voltage signal; and a voltage distributing unit including a non-trimmable, temperature sensitive variable resistor, the resistance of which varies with temperature for automatically compensating a voltage signal variation according to a change in temperature, wherein the voltage distributing unit distributes the regulated voltage signal, and outputs a feedback voltage signal to the regulation sense amplifier dependent on temperature, and a reference voltage signal, independent of the temperature.

2. The reference voltage signal generating device of claim 1, wherein the voltage distributing unit comprises:

a first resistance element connected to the regulation sense amplifier and a first output terminal from which the feedback voltage signal is outputted;

a second resistance element connected to the first output terminal and a ground, wherein the resistance value of the second resistance element varies with temperature;

a third resistance element connected to the regulation sense amplifier and a second output terminal from which the reference voltage signal outputted; and a fourth resistance element connected to the second output terminal and the ground.

3. The reference voltage signal generating device of claim 1, wherein the voltage signal generating unit comprises a current mirror, the current mirror including:

a first switching element and a second switching element, wherein both the first switching element and the second switching element receive the power supply voltage signal;

a third switching element connected to the first switching element and a ground; and a fourth switching element connected to the second switching element and the ground.

4. The reference voltage signal generating device of claim 3, wherein, the first switching element is a PMOS transistor, the second switching element is a diode-connected PMOS transistor, the third switching element is an NMOS transistor, and the fourth switching element is a diode-connected NMOS transistor.

5. The reference voltage signal generating device of claim 4, wherein gates of the first switching element and the second switching elements are connected to each other and are applied a potential at a common node of the second switching element and the fourth switching element.

6. The reference voltage signal generating device of claim 5, wherein gates of the third switching element and the fourth switching elements are connected to each other and are supplied a potential at a common node of the first switching element and the third switching element.

7. The reference voltage signal generating device of claim 6, wherein the voltage signal generating unit further comprises a fifth switching element, and wherein the fifth switching element is a PMOS transistor coupled to the second switching element and a third output terminal, from which the regulation voltage signal is outputted, and wherein the gate of the fifth switching element is supplied a potential from the common node.

8. The reference voltage signal generating device of claim 7, wherein the voltage signal generating unit further comprises, a fifth resistance element connected between the fourth switching element and the ground; and a sixth resistance element connected between the third output terminal and the ground, and wherein the sixth resistance element is connected in parallel with the fifth resistance element.

9. The reference voltage signal generating device of claim 1, wherein the regulation sense amplifier comprises:

a sixth switching element operating in response to an enable signal and receiving the power supply voltage signal;

a current mirror connected to the sixth switching element;

a seventh switching element connected to the current mirror and receiving the first voltage signal from the voltage signal generating unit;

an eighth switching element connected to the current mirror and receiving the feedback voltage signal from the voltage distributing unit;

a first current sinking means connected to a common node of the seventh switching element, the eighth switching element and the ground; and a ninth switching element connected to the sixth switching element and the fourth output terminal from which the regulation voltage signal outputted.

10. The reference voltage signal generating device of claim 9, wherein the sixth switching element is a PMOS transistor operating in response to the enable signal and the seventh switching element is an NMOS transistor, the gate of which receives the first voltage signal from the voltage signal generating unit, and wherein the eighth switching element is an NMOS transistor, the gate of which receives the feedback voltage signal from the voltage distributing unit and the ninth switching element is a PMOS transistor, the gate of which receives the potential at a common node of the eighth switching element and the tenth switching element.

11. The reference voltage signal generating device of claim 9, wherein, the second current mirror comprises:

a tenth switching element coupling to the sixth switching element, wherein the tenth switching element is a diode-connected PMOS transistor; and an eleventh switching element coupling to the sixth switching element, wherein the eleventh switching element is a PMOS transistor, of gate of which is connected to a gate of the tenth switching element.

12. The reference voltage signal generating device of claim 11, wherein the regulation sense amplifier further comprises a second current sinking means connected to a common node of the ninth switching element, the fourth output terminal and the ground.

13. The reference voltage signal generating device of claim 12, wherein both the first current sinking means and the second current sinking means are NMOS transistors.

14. The reference voltage signal generating device of claim 13, wherein the regulation sense amplifier further comprises a control means for controlling amounts of current flowing to the first current sinking means and the second current sinking means.

15. The reference voltage signal generating device of claim 14, wherein the control means comprises:

a twelfth switching element connected to the sixth switching element, wherein the twelfth switching element is a diode-connected PMOS transistor;

a thirteenth switching element connected to the sixth switching element, wherein the thirteenth switching element is a diode-connected NMOS transistor, the gate of which is connected to the twelfth switching element.

16. The reference voltage signal generating device of claim 15, wherein both the first current sinking means and the second current sinking means are connected to a common node of the twelfth switching element and the thirteenth switching element.

* * * * *